US005472100A

United States Patent [19]

Garrison et al.

[11] Patent Number: 5,472,100

[45] Date of Patent: Dec. 5, 1995

[54] GREETING CARD DISPLAY RACK

[75] Inventors: Donald W. Garrison, Goshen; William S. Keighley, Cincinnati; Jerry D. Pavone, Cincinnati; Kevin P. Shatzer, Cincinnati, all of Ohio

[73] Assignee: Hamilton Fixture Company, Hamilton, Ohio

[21] Appl. No.: 92,369

[22] Filed: Jul. 15, 1993

[51] Int. Cl.[6] ..... A47F 5/00

[52] U.S. Cl. ..... 211/45; 211/126; 211/50; 211/194

[58] Field of Search ..... 211/45, 47, 50, 211/55, 56, 58, 126, 128, 129, 194, 131; 206/509; 312/126; D6/455, 474, 460; D20/21; 40/124, 124.2, 124.4

[56] References Cited

U.S. PATENT DOCUMENTS

| | | | |
|---|---|---|---|
| D. 224,062 | 6/1972 | Larson | D80/9 |
| D. 243,907 | 4/1977 | Ferriter et al. | D6/188 |
| D. 249,433 | 9/1978 | Carlsen | D6/184 |
| D. 253,080 | 10/1979 | Corrigan | D6/188 |
| D. 265,024 | 6/1982 | Johnson et al. | D6/24 |
| D. 296,277 | 6/1988 | Hardy | D6/455 |
| D. 296,278 | 6/1988 | Hardy | D6/457 |
| D. 296,283 | 6/1988 | Hardy | D6/474 |
| D. 310,456 | 9/1990 | Hodgson et al. | D6/491 |
| D. 327,590 | 7/1992 | Hardy | D6/454 |
| D. 335,785 | 5/1993 | Winter et al. | D6/467 |
| D. 337,676 | 7/1993 | Hardy | D6/491 |
| 838,294 | 12/1906 | Zeiner | 211/58 |
| 929,714 | 8/1909 | Schlegel | 211/58 |
| 2,879,899 | 3/1959 | Shenkin | 211/55 |
| 3,612,292 | 10/1971 | Nervig | 211/184 |
| 3,667,826 | 6/1972 | Wood et al. | 312/118 |
| 3,891,092 | 6/1975 | Surrette et al. | 211/13 |
| 3,942,647 | 3/1976 | Crosslen | 211/144 |
| 4,102,072 | 7/1978 | Buschman | 40/124.2 |
| 4,126,230 | 11/1978 | Tyson et al. | 211/50 |
| 4,204,602 | 5/1980 | Dunchock | 211/13 |
| 4,211,331 | 7/1980 | Salmon et al. | 211/13 |
| 4,216,867 | 8/1980 | Sturm | 211/77 |
| 4,609,975 | 9/1986 | Badolato et al. | 362/125 |
| 4,621,878 | 11/1986 | Johnson et al. | 312/257 |
| 4,655,353 | 4/1987 | Johnson et al. | 211/189 |
| 4,673,090 | 6/1987 | Crosslen | 211/183 |
| 4,678,086 | 7/1987 | Nervig et al. | 211/47 |
| 4,744,473 | 5/1988 | Hardy | 211/55 |
| 4,796,764 | 1/1989 | Hardy | 211/184 |
| 4,817,900 | 4/1989 | Whittington et al. | 248/225.1 |
| 4,841,654 | 6/1989 | Hodgson et al. | 40/642 |
| 4,937,106 | 6/1990 | Eliason | 428/4 |
| 4,949,849 | 8/1990 | Hardy | 211/55 |
| 4,961,295 | 10/1990 | Kosch, Sr. et al. | 211/94 X |
| 4,976,359 | 12/1990 | Hardy | 211/58 |
| 5,050,747 | 9/1991 | Krautsack | 211/50 |

(List continued on next page.)

OTHER PUBLICATIONS

Photocopy of 3–G Spinner Brochure (no date available).

*Primary Examiner*—Leslie A. Braun
*Assistant Examiner*—Catherine S. Collins
*Attorney, Agent, or Firm*—Wood, Herron & Evans

[57] ABSTRACT

A greeting card display device comprising a base and a pair of display modules stacked one atop another and mounted on the base. Each module comprises four upright support panels secured together at adjacent vertical edges, and a plurality of card-supporting tiers secured to the upright support panels. Each of the support panels is in the form of a U-shaped channel section having a pair of side walls and a web wall connected between the side walls. Adjacent vertical edges of the support panels are secured together by securing the side wall of one of the adjacent panels to the web wall of the other adjacent panel. The panels include a plurality of slots which accept tabs on the tiers. Each tier comprises a back, bottom and a front wall connected at adjacent horizontal edges, a pair of securement tabs connected at the upper free edge of the back wall and projecting upwardly and rearwardly, and a pair of securement tabs connected to the lower edge of the back wall and projecting downwardly and rearwardly.

12 Claims, 2 Drawing Sheets

U.S. PATENT DOCUMENTS 5,184,737 2/1993 Hardy ..... 211/55
5,185,971 2/1993 Johnson, Jr. ..... 211/94 X
5,193,696 3/1993 Price, Jr. et al. ..... 211/162
5,286,103 2/1994 Price, Jr. et al. ..... 211/163 X
5,292,010 3/1994 Pickles et al. ..... 211/41
5,328,037 7/1994 Fujii ..... 211/55
5,346,079 9/1994 Price et al. ..... 211/131

GREETING CARD DISPLAY RACK

FIELD OF THE INVENTION

This invention relates generally to display racks, and more particularly to display racks employed in the display of greeting cards and the like.

BACKGROUND OF THE INVENTION

Display racks employed for use in displaying greeting cards for retail sale have generally been of a construction having a base, a turntable mounted atop the base, and an upright display rack portion mounted for swiveling movement atop the turntable. The upright portion of the display rack has generally been fabricated of four corner posts, which corner posts are secured to a bottom plate or base, with several greeting card supporting "tiers" spanning between the uprights for supporting the greeting cards therein. The tiers have traditionally been either screwed to the uprights with bolts and thumb nuts, or the uprights themselves have contained tracks along their lengths such that the tiers are slid downwardly into these tracks and stacked one atop another.

The above-described methods of fabricating such greeting card display racks have required that the components be shipped in three boxes; one box would contain the four upright poles, another box would contain the tiers, and the third box would contain the base. Therefore, one greeting card display rack required three separate boxes, thus lending to confusion and misshipment of appropriate boxes. Thus, oftentimes a retailer or field representative would get two boxes of poles and one base box, for example, or two boxes of bases and one tier box. Accordingly, the number of boxes required to ship component parts for constructing a single greeting card display rack has been confusing and cumbersome.

Another problem associated with these traditional types of fabrication of greeting card display racks has been the cumbersome nature of their assembly. Specifically, each of the four corner poles must be first secured to the bottom base plate. It will be appreciated that the uprights, on the order of six feet long, being cantilevered off the base plate, are generally unwieldy and hard to control, particularly in light of the fact that the tiers must be secured to the uprights during assembly.

Further complicating the task of assembling these traditional greeting card display racks has been the method by which the tiers are secured to the uprights. As mentioned above, these tiers have traditionally been either screwed to the uprights, or slid into tracks on the uprights. Either method of assembly is time consuming and tedious. In addition, the latter method of assembly requires disassembly of the entire display rack to replace damaged or broken tiers.

SUMMARY OF THE INVENTION

It has therefore been an objective of the present invention to devise a greeting card display rack which is much simpler and quicker to assemble in the field.

It has been another objective of the present invention to devise a greeting card display rack which can be packaged for shipment in a fewer number of boxes, thus reducing or eliminating the problem of shipping and/or receiving mismatched boxes.

Another objective of the present invention has been to devise a greeting card display rack which obviates the need to utilize corner posts which are inherently cumbersome and unwieldy to manage during the assembly of the greeting card display rack.

Yet another objective of the present invention has been to devise a greeting card display rack which eliminates the need to screw tiers to the corner posts, or slide tiers into tracks in the corner posts.

In accordance with the stated objectives of the present invention and a preferred embodiment thereof, the present invention is a greeting card display device comprising a base and a pair of display modules stacked one atop another and mounted on the base. Each display module comprises four upright support panels secured together at adjacent vertical edges, and a plurality of card supporting tiers secured to the upright support panels.

Each support panel is in the form of a U-shaped channel section having a pair of side walls and a web wall connected between the side walls. Adjacent vertical edges of the support panels are secured together by securing the side wall of one of the adjacent panels to the web wall of the other adjacent panel.

The upright support panels include a plurality of slots therethrough, and the card supporting tiers include tabs for removable securement into the slots.

Preferably the lower one of the pair of display modules includes an upwardly extending flange for slidable engagement by the upper one of the pair of display modules.

The invention further provides a card supporting tier for removable securement to a greeting card display device comprising back, bottom and front walls connected at adjacent horizontal edges, a pair of securement tabs connected to the upper free edge of the back wall, and another pair of securement tabs connected to the lower edge of the back wall. The pair of tabs connected to the upper free edge of the back wall project upwardly and rearwardly, and the pair of tabs connected to the lower edge of the back wall project downwardly and rearwardly.

The greeting card display device of the present invention presents numerous advantages. First, assembly of the device in the field is greatly facilitated, as one need only remove both display modules from their respective boxes, and place the top module on the lower module. Thus, there are no full height poles with which to deal during assembly.

Second, the need to secure each and every tier to its supporting poles with fasteners has been eliminated, as all of the tiers are attached directly to a support panel. As the tiers can be preassembled to the support panels, in the field one need only to place the top module upon the lower module to completely assemble the device.

Third, the U-shaped design of each of the individual support panels, in combination with the method of securing the upright support panels at their adjacent vertical edges, provides a much structurally stiffer display than the traditional greeting card displays.

Fourth, should individual tiers become damaged or broken, one need not disassemble the entire display to replace them, as the securement tabs of the damaged tiers can simply be snapped out of their respective slots, and a new tier inserted therefor.

These and other objects and advantages of the present invention will become more readily apparent during the following detailed description taken in conjunction with the drawings herein, in which:

DETAILED DESCRIPTION OF THE INVENTION

Figure 1:
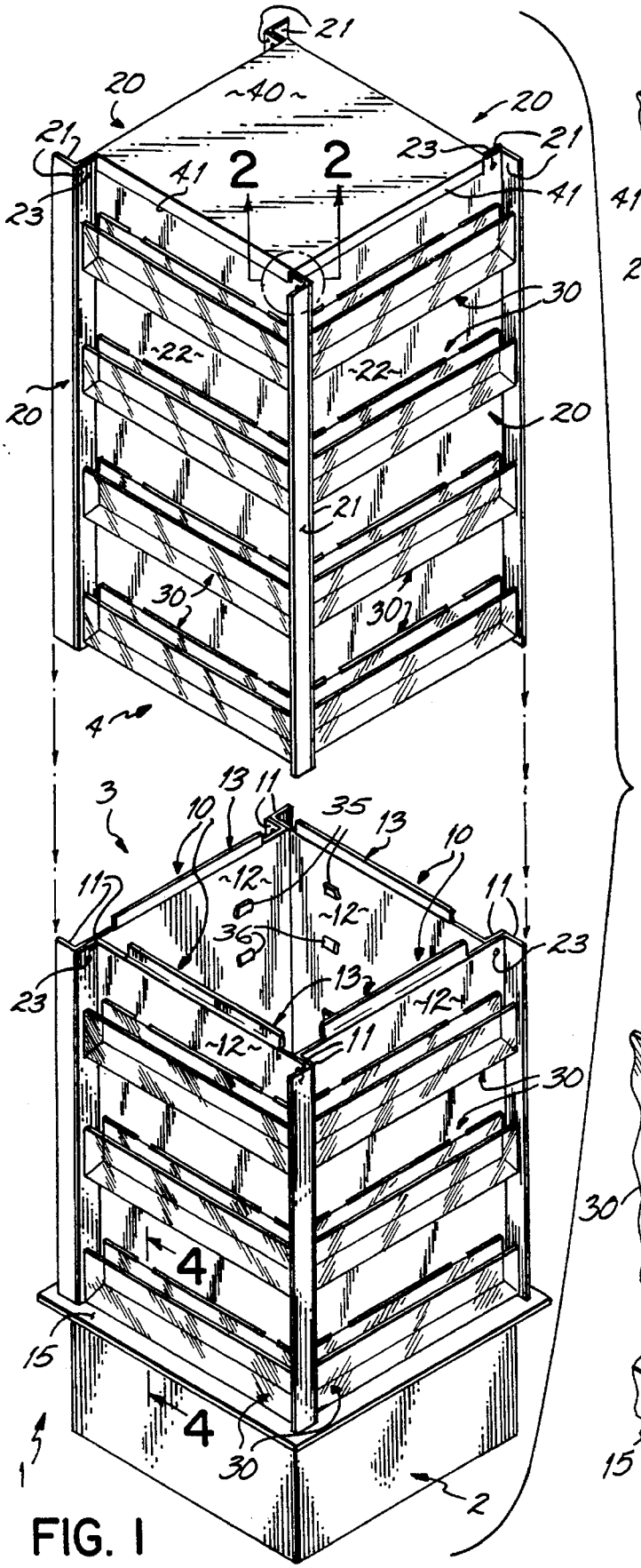
FIG. 1 is a partially exploded perspective view of the greeting card display device of the present invention.

With reference first to FIG. 1, there is illustrated the greeting card display device 1 of the present invention. The device 1 comprises, generally, a pedestal base 2, and a pair of display modules 3 and 4 stacked one atop another and mounted on the pedestal base 2.

Figure 5:
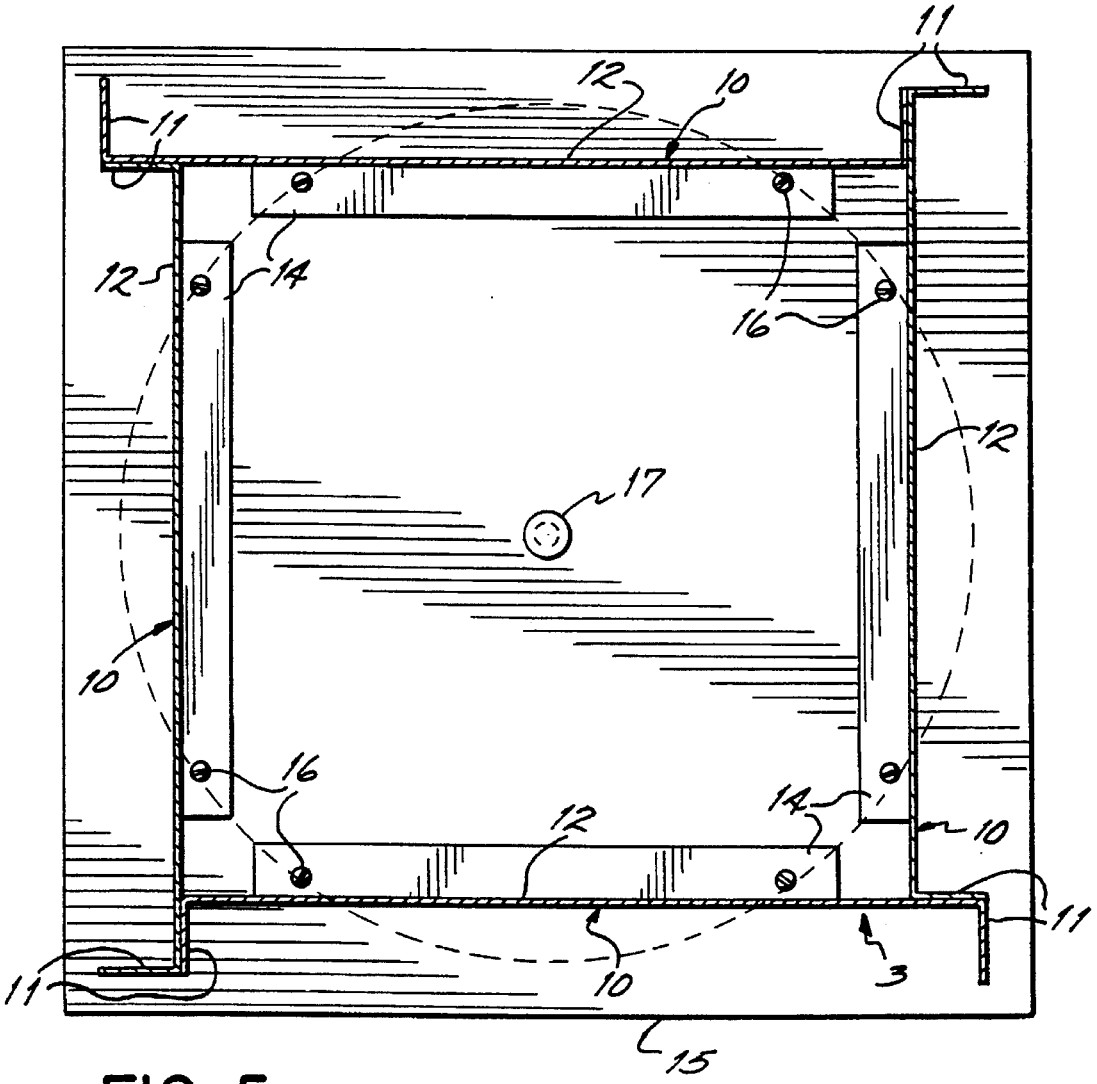
FIG. 5 is a top plan view of the greeting card display device.

The lower display module 3 comprises four identical support panels 10. Each of the support panels 10 is in the form of a U-shaped channel section (in cross-section) having a pair of side walls 11 and a web wall 12 connected between the side walls 11. The upper edge of each of the support panels 10 of the lower display module 3 includes an upwardly and inwardly extending flange 13. The lower edges of support panels 10 include inwardly facing lip portions 14 for securing to a base plate 15 as by fasteners 16 (FIG. 5). A turntable (not shown but known to those skilled in the art) is disposed between the base plate 15 and pedestal base 2 and is secured there by a bolt 17 passing through base plate 15 and pedestal base 2 (FIG. 5).

Figure 2:
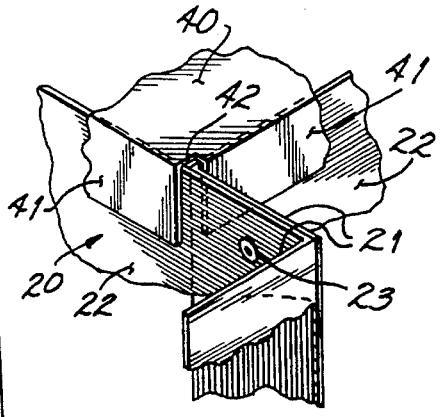
FIG. 2 is the circled detail 2—2 of FIG. 1, greatly enlarged, illustrating the method of attaching adjacent vertical edges of support panels.

The upper display module 4 similarly includes four identical upright support panels 20, each of which includes a pair of side walls 21 and a web wall 22 connected between the side walls 21. As can best be seen in FIG. 2, adjacent edges of the upright support panels 20 of top display module 4 (and upright support panels 10 of lower display module 3) are secured together by securing the side wall 21 of one adjacent panel to the web wall 22 of the other adjacent panel as by rivets, one of which is shown at 23.

Figure 3:
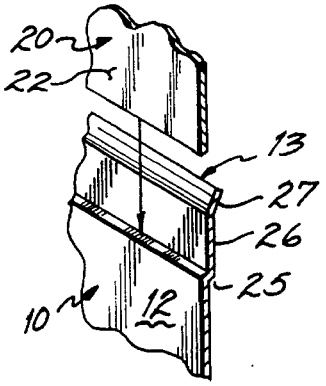
FIG. 3 is a partial perspective view, in cross section, of the upper edge of the lower display module with flange and the lower edge of the upper module.

Referring now to FIG. 3, the flange 13 of lower display module 3 is shown in more detail. The flange 13 includes an offset portion 25, a planar portion 26 generally parallel to the web wall 12 of the support panel 10, and an inwardly extending lip portion 27. Lip portion 27 aids in guiding the lower edge of support panel 20 over the flange 13. Offset portion 25 allows the web walls 22 and 12 of the support panels 20 and 10, respectively, which define a substantially uninterrupted display wall, to assume a generally coplanar relation when the upper module 4 is installed atop the lower module 3.

Figure 4:
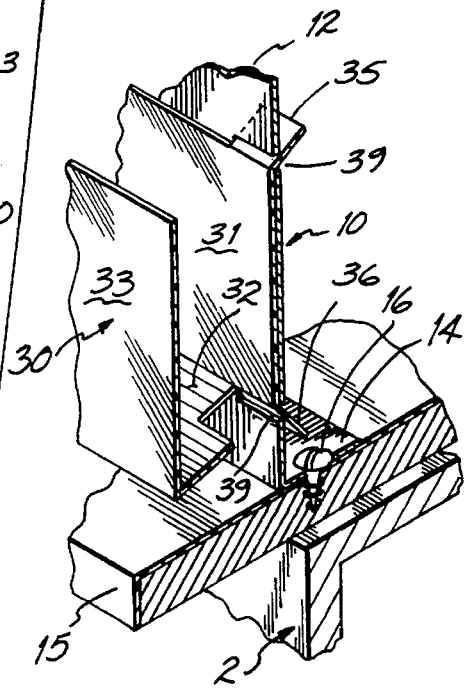
FIG. 4 is a view taken along line 4—4 FIG. 1 illustrating the securement tabs of the tiers snap fitted into slots in one of the support panels.
Figure 6:
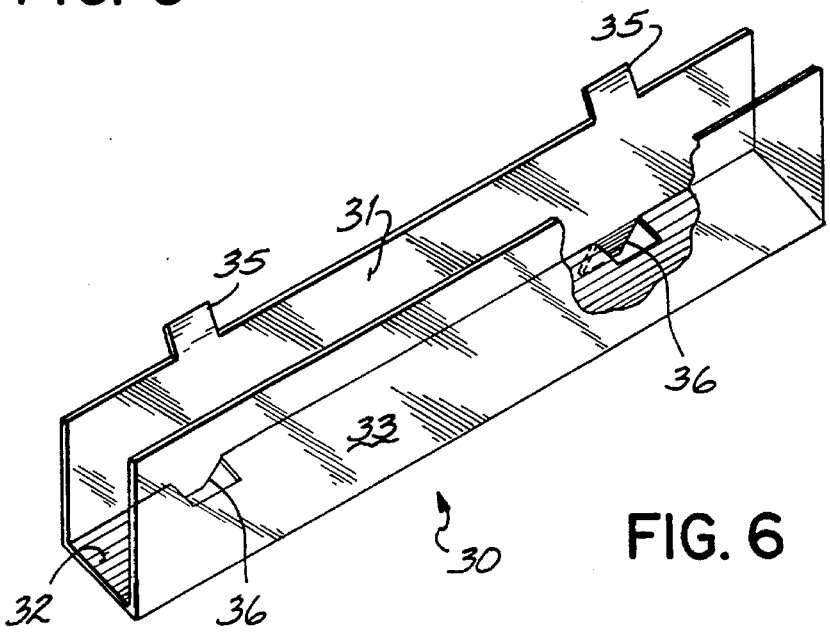
FIG. 6 is a perspective view of one of the tiers of the greeting card display device.

Upper 4 and lower 3 modules of the display device 1 include a plurality of tiers 30 removable secured to the support panels 20 and 10, respectively. Referring to FIGS. 4 and 6, it will be seen that each card supporting tier 30 has a back 31, a bottom 32 and a front 33. Each tier 30 includes a pair of securement tabs 35, 35 connected to the upper free edge of the back wall 31, and another pair of securement tabs 36, 36 connected to the lower edge of the back wall. The pair of tabs 35, 35 connected to the upper free edge of the back 31 preferably project upwardly and rearwardly, whereas the pair of tabs 36, 36 connected to the lower edge of the back wall 31 preferably project downwardly and rearwardly. As can be seen in FIG. 4, the tab pairs 35, 35 and 36, 36 cooperate with slots 39 in the web wall 12 of support panel 10. The tiers 30 are preferably manufactured of a resilient material, for example PETG manufactured by Kodak, such that the rear wall 31 and tab pairs 35, 35 and 36, 36 can be slightly bowed to allow insertion of first one set of tabs into slots 39, and then the other set of tabs into the slots 39. After insertion of the tabs into the slots, the tier 30 being of a resilient material, the tier 30 will spring back to its original configuration, with rear wall 31 lying against web wall 12 of support panel 10. Tiers 30 are fabricated from blanks and are formed into their finished shapes by strip heating. Tiers 30 are removably secured to upper module 4 in the same manner.

Referring back to FIG. 1, it will be seen that the side walls 11 of lower support panels 10 and the side walls 21 of upper support panels 20 conveniently serve as end walls for each of the tiers 30. In addition, a decorative top plate 40 having downwardly turned edges 41 and notches 42 at respective corners may be placed atop the upper module 4.

The display device of the present invention is fabricated and shipped to destinations in the following manner. First, support panels 10 of lower display module 3 are secured together by rivets 23 at adjacent side walls 11 and web walls 12. The lower module 3 is then secured to base plate 15 via fasteners 16. A turntable (not shown) is placed atop the pedestal base 2, and the lower module 3 is, in turn, placed atop the turntable. Bolt 17 secures lower module 3, turntable and pedestal base 2 together. Tiers 30 are then snap fitted into the upright support panels 10. The lower portion of the greeting card display device is then ready to be packed in an appropriate shipping container.

The upper module 4 is assembled in much the same manner. In order to utilize one standard size box for shipping both the upper portion and lower portion of the display, the support panels 20 of the upper module 4 are longer than the support panels 10 of the lower module 3, and in fact are approximately equal in height to the total height of the lower module 3, base plate 15, and pedestal base 2. By designing the modules to have the appropriate dimensions, a single size box can be utilized for packing both modules, thus simplifying the packaging process.

Once the unit 1 has reached its shipping destination, for example, to a field sales representative, that person need only remove each unit from its respective packaging and simply place the upper module 4 atop the lower module 3. The lower edges of the support panels 20 of the upper module 1 may conveniently be fastened to the flange 13 of the lower module 3, by, for example, screws, to secure the upper module 4 to the lower module 3. At that point the device 1 is completely assembled, and no further assembly is required, as the units are shipped with the tiers 30 pre-installed.

As will be readily appreciated from the above description, the greeting card display device of the present invention provides numerous advantages over the typical prior art greeting card display device which utilize an upright support pole at each corner of the device with the tiers secured between the uprights by fasteners at their ends. The device of the present invention is much easier to install in the field, as one need only place the upper unit 4 atop the lower unit 3 to completely assemble the display. There is no need to attach the tiers 30 to the modules, as the tiers 30 have been preassembled to the support panels. Further, should one or more of the tiers become damaged at any time, one need not disassemble the entire unit to reach and replace the damaged tier as in some prior art units which utilize tracks in the corner poles, with the tiers sliding down into the tracks and resting one atop another. And further, the number of boxes or packaging containers typically utilized to ship prior art greeting card display devices has been reduced from three to two, as traditionally the upright support poles were shipped in one container, the tiers were shipped in another container and the base was shipped in yet a third container.

Those skilled in the art will readily recognize numerous adaptations and modifications which can be made to the greeting card display device of the present invention which will result in an improved display device, yet all of which will fall within the spirit and scope of the present invention as defined in the following claims. Accordingly, the invention is limited only by the claims and their equivalents.

What is claimed is:

1. A card supporting tier for removable securement to a greeting card display device comprising:

back, bottom and front walls connected at adjacent horizontal edges, said back wall being substantially planar;

a pair of securement tabs connected to the upper free edge of said back wall, said tabs each consisting of an angled planar member forming a non-orthogonal angle with respect to the back wall of the tier; and another pair of securement tabs connected to the lower edge of said back wall wherein said pair of tabs connected to the upper free edge of said back wall project upwardly and rearwardly relative to said back wall and said pair of tabs connected to the lower edge of said back wall project downwardly and rearwardly relative to said back wall.

2. A stackable display module for use in a greeting card display device comprising:

four upright support panels, each said support panel being in the form of a U-shaped channel section having a pair of side walls and a web wall connected between said side walls, said web walls of one said module being adapted to fit together with web walls of another said module stackable atop said one module such that adjacent upper and lower web walls of said panels define a substantially planar display wall; and a plurality of greeting card supporting tiers secured to said web walls of said upright support panels, said tiers being positioned within and extending substantially entirely the lateral extent of said side walls of said upright support panels.

3. A greeting card display device comprising:

a base; and a pair of display modules stacked one atop another and mounted on said base, each said module comprising:

four upright support panels secured together at adjacent vertical edges, each said support panel being in the form of a U-shaped channel section having a pair of side walls and a substantially continuous web wall connected between said side walls, and a plurality of card supporting tiers secured to said web walls of said upright support panels;

adjacent upper and lower support panels of said modules being adapted to fit together such that adjacent edges of said upper and lower web walls of said panels are removably secured to each other to define a substantially uninterrupted planar display wall.

4. The greeting card display device of claim 3 wherein adjacent vertical edges of said support panels are secured together by securing said side wall of one of the adjacent panels to said web wall of the other adjacent panel.

5. The greeting card and display device of claim 4 wherein said upright support panels include a plurality of slots therethrough, and each said card supporting tier comprises:

back, bottom and front walls connected at adjacent horizontal edges;

a pair of securement tabs connected to the upper free edge of said back wall and projecting upwardly and rearwardly relative to said back wall, and a pair of securement tabs connected to the lower edge of said back wall and projecting downwardly and rearwardly relative to said back wall;

said securement tabs being for removable securement into said slots.

6. The greeting card display device of claim 3 wherein said upright support panels include a plurality of slots therethrough, and said card supporting tiers include tabs for removable securement into said slots.

7. The greeting card display device of claim 3 wherein the lower one of said pair of display modules includes an upwardly extending flange for slidable engagement by the upper one of said pair of display modules.

8. A greeting card display device of claim 1 wherein the upper one of said modules having a height H1;

the lower one of said modules having a height H2;

said base having a height H3;

H1 being approximately equal to the sum of H2 and H3;

said lower module and said base thereby being shippable in a shipping container which is substantially equal in size to a shipping container in which said upper module is shipped.

9. A greeting card display device comprising:

a base;

a pair of display modules slidably mountable one atop another and mounted on said base, each said module comprising four upright support panels secured together at adjacent vertical edges; and a plurality of card supporting tiers secured to said upright support panels;

said support panels of the lower one of said display modules including an upwardly extending flange with an inward offset therein to fits behind an associated support panels of the upper one of said display modules such that adjacent upper and lower support panels define a substantially uninterrupted display wall said flange being an extension of said support panels;

whereby when lower edges of said support panels of said upper module slide down over said flange, said inward offset allows said support panels of said lower module to be generally co-planar with corresponding ones of said support panels of said upper module.

10. A greeting card display device comprising:

a base, and a pair of display modules slidably mounted one atop another and mounted on said base, each said module comprising:

four upright support panels secured together at adjacent vertical edges, said panels each said panel including a rewardly spaced wall including plurality of slots therethrough, said rewardly spaced walls of the lower module being co-planar with corresponding rearwardly spaced walls of said upper module, said rearwardly spaced walls being adapted to fit together such that adjacent edges of said upper and lower rearwardly spaced walls of said panels are removably secured to each other to define substantially uninterrupted display walls, and a plurality of greeting card supporting tiers secured to said upright support panels, each said card supporting tier comprising:

back, bottom and front walls connected at adjacent horizontal edges, said back wall being substantially planar;

a pair of securement tabs connected to the upper free edge of said back wall and projecting upwardly and rearwardly relative to said back wall; and a pair of securement tabs connected to the lower edge of said back wall and projecting downwardly and rearwardly relative to said back wall;

said securement tabs being for removable securement into said slots.

11. The greeting card display device of claim 10 wherein each said support panel being in the form of a U-shaped channel section having a pair of side walls and a web wall connected between said side walls said web walls defining said rearwardly spaced walls, adjacent vertical edges of said support panels being secured together by securing said side wall of one of the adjacent panels to said web wall of the other adjacent panel.

12. A display module for use in a greeting card display device comprising:

four upright support panels secured together at adjacent vertical edges, said panels including a plurality of slots therethrough, each said panel having a pair of side walls and a web wall connected between said side walls, said support panels of one said module being adapted to fit together with support panels of another said module stacked atop said one module such that adjacent upper and lower web walls of said panels define a substantially uninterrupted display walls, and a plurality of greeting card supporting tiers secured to said upright support panels, each said card supporting tier comprising:

back, bottom and front walls connected at adjacent horizontal edges, said back wall being substantially planar;

a pair of securement tabs connected to the upper free edge of said back wall and projecting upwardly and rearwardly relative to said back wall; and a pair of securement tabs connected to the lower edge of said back wall and projecting downwardly and rearwardly relative to said back wall;

said securement tabs being for removable securement into said slots.

* * * * *

UNITED STATES PATENT AND TRADEMARK OFFICE

CERTIFICATE OF CORRECTION

PATENT NO. : 5,472,100

DATED : December 5, 1995

INVENTOR(S) : Donald Wayne Garrison et al

It is certified that error appears in the above-indentified patent and that said Letters Patent is hereby corrected as shown below:

Column 5, line 47, insert -- uninterrupted -- after "substantially."

Column 6, line 49, "fits" should read -- fit --.

Column 6, line 50, "panels" should read -- panel --.

Column 6, line 66, "said panels" should be deleted.

Column 6, line 67, -- a -- should be inserted after "including."

Column 6, line 67 "rewardly" should read -- rearwardly --.

Column 7, line 1, "rewardly" should read -- rearwardly --.

Column 8, line 13, "walls" should read -- wall --.

Signed and Sealed this

Twenty-seventh Day of August, 1996

Bruce Lehman

*Attest:*

BRUCE LEHMAN

*Attesting Officer*

*Commissioner of Patents and Trademarks*